United States Patent [19]

Verney

[11] Patent Number: 4,580,836

[45] Date of Patent: Apr. 8, 1986

[54] CHAIR

[75] Inventor: Claude J. Verney, Kirchberg, Switzerland

[73] Assignee: Intercollection Development S.A. Gyrenmoos, Kirchberg, Switzerland

[21] Appl. No.: 563,913

[22] Filed: Dec. 21, 1983

[30] Foreign Application Priority Data

Dec. 23, 1982 [CH] Switzerland ..... 7549/82

[51] Int. Cl.[4] ..... A47C 3/00

[52] U.S. Cl. ..... 297/296; 297/443; 297/DIG. 2

[58] Field of Search ..... 297/296, 297, 298, 300, 297/306, 440, 443, 444, DIG. 2; 403/227, 224

[56] References Cited

U.S. PATENT DOCUMENTS

| | | | |
|---|---|---|---|
| 2,456,480 | 12/1948 | Austin | 403/227 |
| 2,815,067 | 12/1957 | Richardson | 297/443 |
| 3,111,344 | 11/1963 | Hoven et al. | 297/DIG. 2 |
| 3,173,723 | 3/1965 | Hoven et al. | 297/DIG. 2 |
| 3,887,156 | 6/1975 | Hugonnier | 403/227 |
| 4,084,850 | 4/1978 | Ambasz | 297/300 |
| 4,157,203 | 6/1979 | Ambasz | 297/300 |
| 4,456,314 | 6/1984 | Messori et al. | 403/227 |

FOREIGN PATENT DOCUMENTS

| | | | |
|---|---|---|---|
| 2428776 | 1/1976 | Fed. Rep. of Germany | 297/440 |
| 895005 | 3/1944 | France | 297/296 |
| 2404137 | 5/1979 | France | 403/227 |

*Primary Examiner*—Francis K. Zugel

*Attorney, Agent, or Firm*—Sughrue, Mion, Zinn, Macpeak, and Seas

[57] ABSTRACT

The seat (1) and the back (2) are identically shaped shells (12) having side supporting ribs (10, 11). With the exception of the portion intended for connection to the other part, the supporting ribs are in the form of channels (13) open at the bottom. The remaining portion is in the form of a hollow cylinder (15) having a partition (17). The connecting members (3, 4) disposed on both sides consist of bent-over spring material (30) in band form. The ends (33, 34) of the arms (31, 32) of the connecting members are integrally fastened in slots (35, 36) in cylindrical pegs (37, 38) by means of screws (39, 40). The pegs (37, 38) are produced with snug fit tolerance in relation to the hollow cylinders (14, 15). An O-ring (40, 41) is compressed by means of a screw (44, 45) between the partition (16, 17) and the peg (37, 38). This provides adequate fastening of the connecting member even when thin-walled moulded polypropylene is used for the shells (12). The chair legs (5–8) can then be fastened in the channels (13), likewise by means of a clamp device, similarly to the arrangement described for the pegs. This permits rational manufacture and stockkeeping.

9 Claims, 10 Drawing Figures

Figure 1:
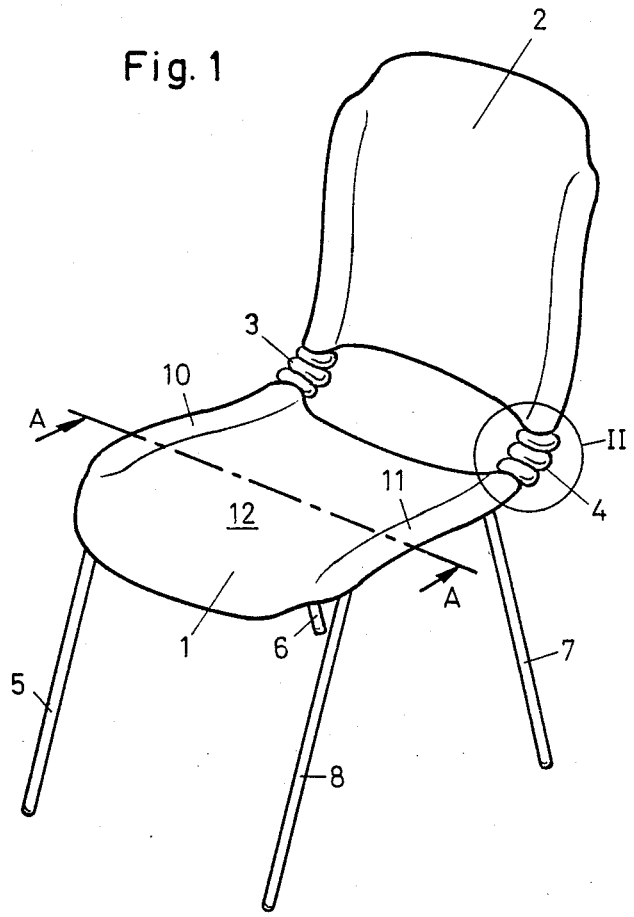

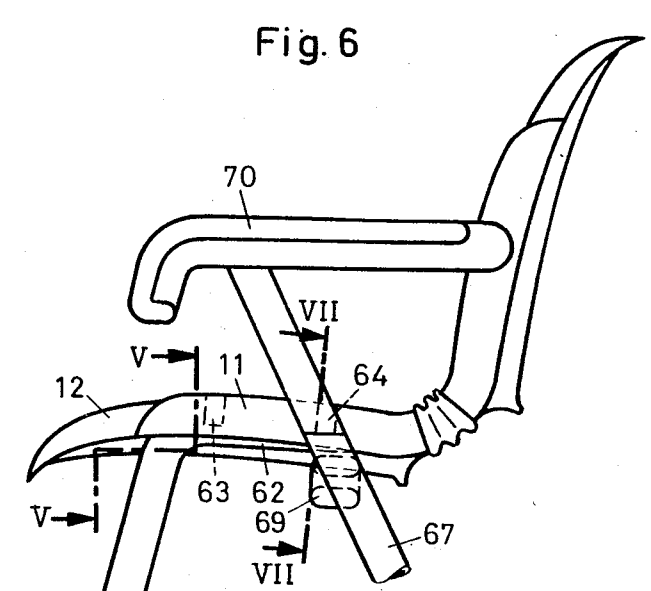
Fig. 6
Fig. 7
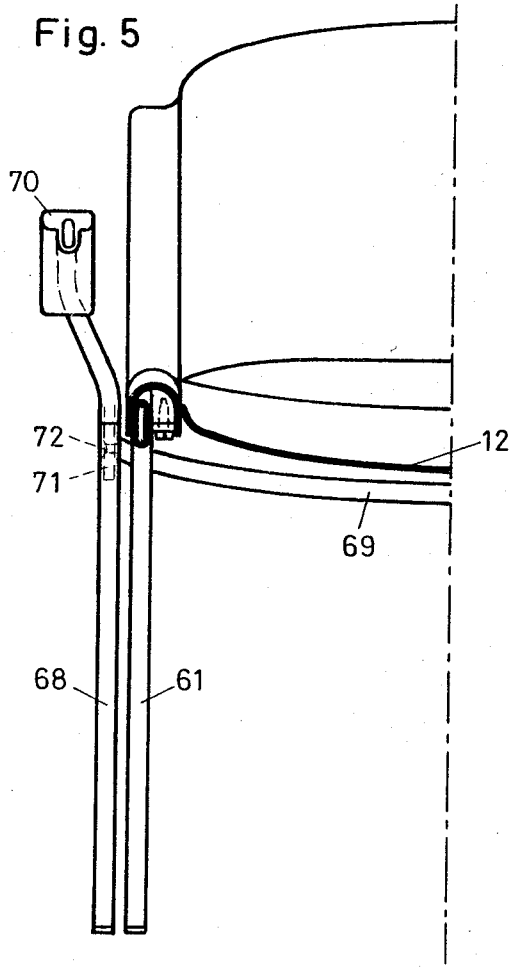
Fig. 5

CHAIR

The present invention relates to a chair having a seat and a back.

Chairs are known in which the region of resilient pivoting of the back relative to the seat permits adjustable resilient pivoting, optionally also from a selectable normal position.

In Swiss Patent No. A 472 198 a rocker member is accordingly held for pivoting about a horizontal pin mounted on the seat, against the action of a coil spring fastened on the seat, and a backrest carrier is mounted on this rocker member in such a manner as to be adjustable in height and also pivotable. Not only is an arrangement of this kind very extravagant in the use of material, but it also entails considerable expense for labour for the production of the component parts and also for assembly, so that the very comfortable chair becomes correspondingly expensive.

In an arrangement according to Swiss Patent No. A 625 688, the seat and the back are joined together only in their edge portions, without a backrest carrier. The connection is resilient, so that the back can be pivoted relative to a side frame support joined to the seat. The back is provided with a padded portion, which is likewise mounted for pivoting relative to the back. Both joints have spring means, so that a force must be applied in order to pivot the parts in relation to one another.

In a first embodiment the spring means comprises a coil spring which is supported on one part and pulls into a socket a pin provided with an arched head. The two parts are pivotable about a pivot axis lying outside this joint arrangement, so that a restoring force is provided when they are swivelled out of a normal position.

In a second embodiment two resilient parts of plastics material are inserted into the divided frame supports and, within a limited pivoting range of a rotatably mounted pressure plate, apply a restoring force to the latter when the back is pivoted out of the normal position. The double joint permits the support of the user's back and neck part, with his body in a relaxed position. In this example also a frame consisting of a multiplicity of component parts is provided for fastening the seat and the back, so that a chair of this kind can be produced only at a high price.

A substantial simplification is proposed in Swiss Patent No. A 611 502. Between the seat and the back, each of which constitutes a self-supporting element, is disposed a connecting member which through its shape acts as a spring. The connecting member, the seat and the back are integrally joined together. Suitable materials are wood, metal, plastics, alone or in combinations. A chair of this kind is naturally very inexpensive to make, because it can be produced by stamping, or in the case of sheet metal by pressing. Owing to the fact that it is possible to make the seat, the back and the connecting member out of the same material, unspecified means must be provided, on the one hand, for providing the connecting member with soft elasticity, and on the other hand for making the seat and the back rigid.

In contrast thereto the invention seeks to provide a chair in which the seat and the back are each inherently stable or rigid and are resiliently joined together by connecting members, without an additional frame being required for fastening the seat and the back.

Figure 2:
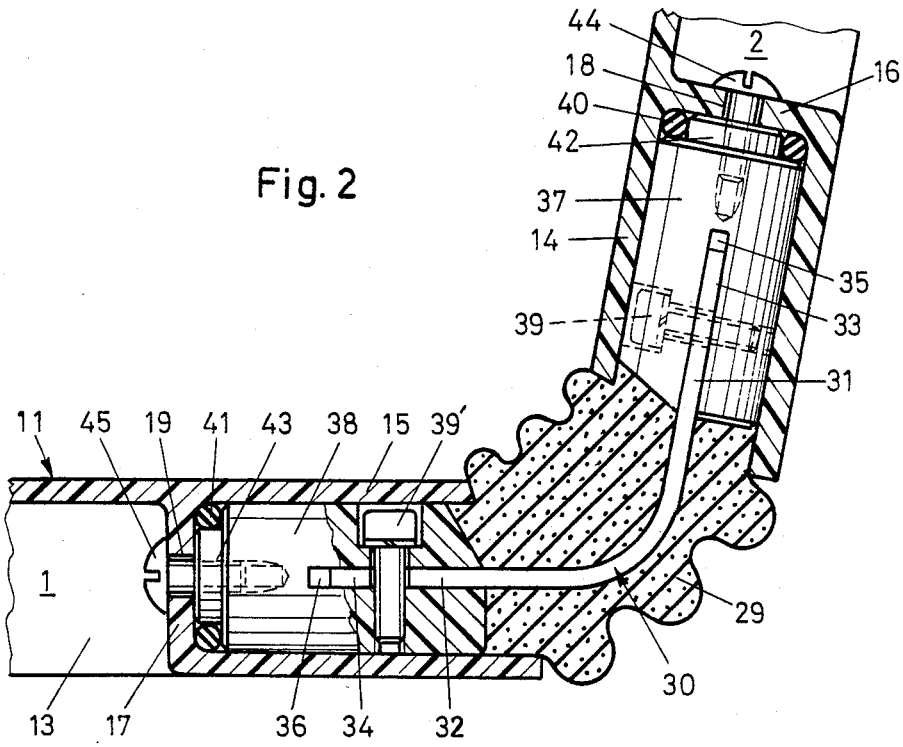
Figure 3:
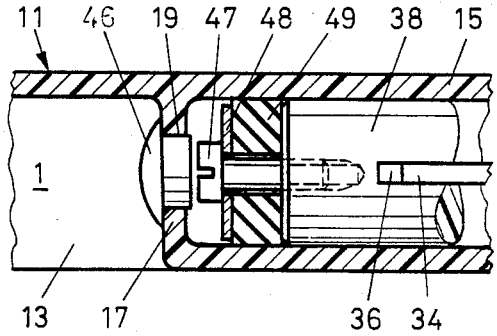
Figure 4:
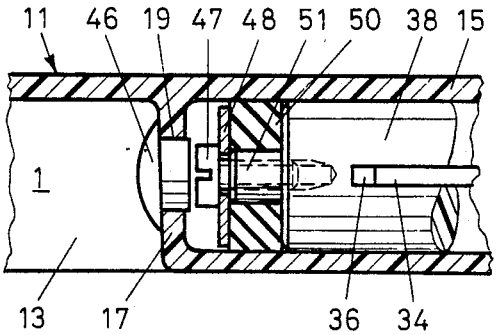
Figure 9:
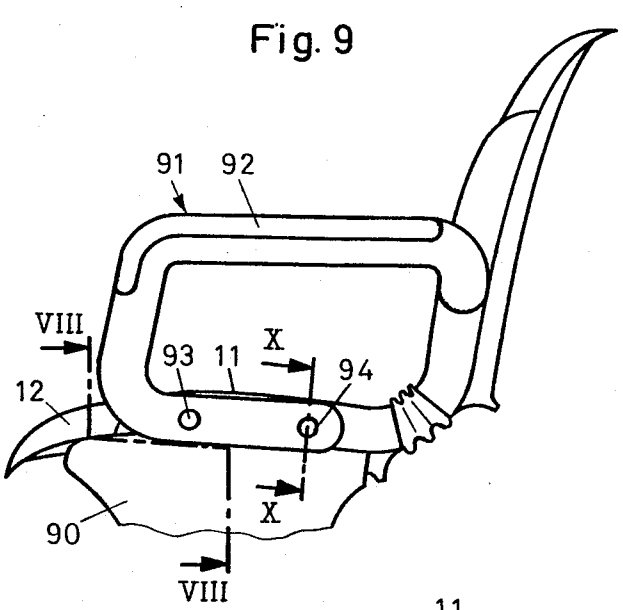
Figure 10:
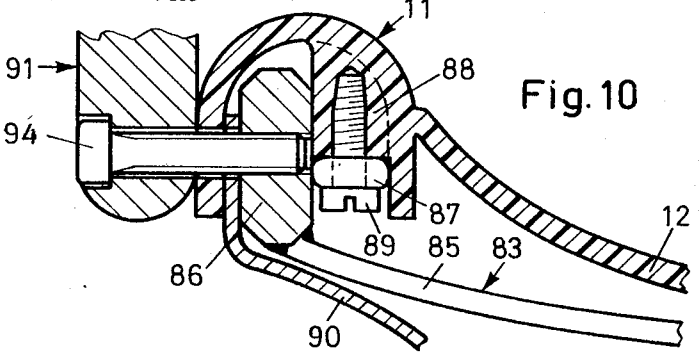
Figure 8:
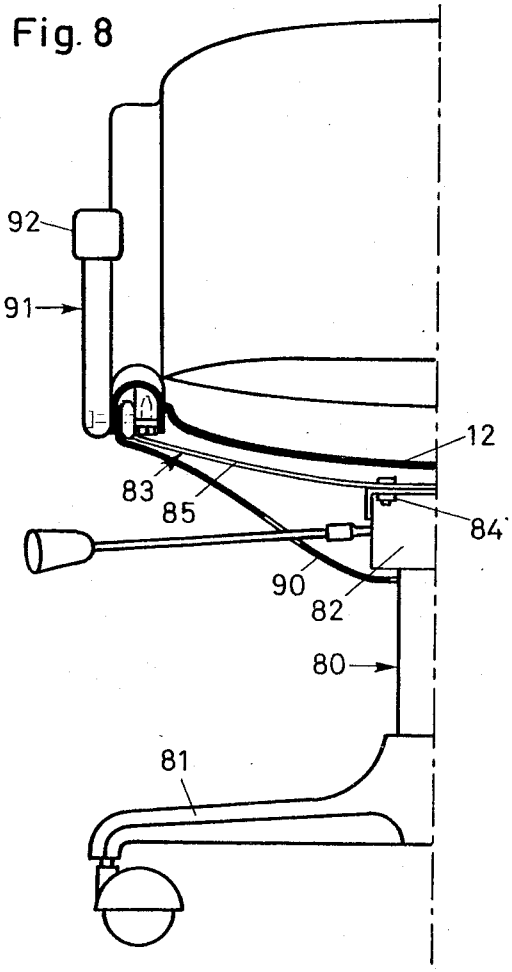

Examples of embodiment of the invention are explained below with reference to the drawings, in which:

FIG. 1 is a view in perspective of a chair according to the invention,

FIG. 2 is a view in section of the connecting members in the region II in FIG. 1, on a larger scale, FIGS. 3 and 4 each show a modification of the types of fastenings for the connecting member according to FIG. 2 in the shells, FIG. 5 is a front view of half of a chair with the seat in section, FIG. 6 is a side elevation of the chair shown in FIG. 5, FIG. 7 is a view in section on the line VII—VII in FIG. 6, on a larger scale, FIG. 8 is a front view, in section on the line VIII—VIII in FIG. 9, of an office chair with a pillar foot, only half of the chair being shown, FIG. 9 is a side elevation of the office chair shown in FIG. 8, and FIG. 10 is a view in section on the line X—X in FIG. 9, on a larger scale.

The chair shown in FIG. 1 consists of the seat 1 and the back 2, which are in the form of shells of identical shape, and of two connecting members 3, 4 for the elastically resilient connection of the seat 1 and the back 2. In addition, the legs 5–8 are fastened on the seat 1. The two identically shaped shells for the seat 1 and back 2 are provided at the sides with two supporting ribs 10, 11 and a plate 12 situated between these supporting ribs 10, 11. The plate 12 is depressed in the centre as a shaped seat, and the portion 13 projecting beyond the supporting ribs 10, 11 is convexly curved, so that in the case of the seat the edge lies under the seat surface and in the case of the back the edge lies behind the support surface. The chair legs 5–8 are inserted into and fastened to the supporting ribs 10, 11, as will be described further later on. The connecting members 3, 4 are also inserted into the supporting ribs 10, 11.

The construction of the supporting members 3, 4 and their fastening in the supporting ribs are illustrated on a larger scale in FIG. 2. With this type of fastening it has been taken into account that the shells consist of polypropylene, which has only limited mechanical strength and in which therefore screw connections clamping a wall part of polypropylene between a screw head and a plate-like part of another rigid material, such as for example the chair legs, would break up unless wall thicknesses corresponding to the forces involved were used, thus entailing additional material.

The connecting members 3, 4 consist mainly of a spring member 30 in band form, which is bent so that the two arms 31, 32 of approximately equal length form an obtuse angle of at least approximately 100°. The ends 33, 34 of these arms 31, 32 are inserted into axial slots 35, 36 in cylindrical pegs 37, 38 and rigidly fastened by means of screws 39, 39', which pass through the arms and are screwed into the opposite side of the slot 35, 36. The portion 41 between the two pegs 37, 38 is integrally foamed polyurethane for protecting the user and the spring member 30 and in an esthetically attractive manner may be identified as a spring member by beads extending around it.

On the other hand, the channels 12, 13 of the supporting ribs 10, 11 are formed in the end portions as cylinders 14, 15 closed at one end. In the closure wall 16, 17 of the cylinders 14, 15 respective holes 18, 19 are provided.

The inside diameter of the cylinders 14, 15 and the diameter of the pegs 37, 38 are dimensioned for a snug fit, so that the pegs 37, 38 can be pushed into the cylinders 14, 15. The pegs 37, 38 are fastened in the cylinders 14, 15 by means of O-rings 40, 41 of resilient material which, as shown in FIG. 2, are laid around a cylindrical guide 42, 43. With the aid of a screw 44, 45 screwed axially into the pins 37, 38, the pins 37, 38 are pulled against the closure wall 16, 17, so that the O-ring 40, 41 is compressed and thus pressed against the wall of the cylinder. This fastening is sufficient to join the two parts of the chair, the seat 1 and the back 2, rigidly together.

Experiments have shown that wall thicknesses of 4 mm are sufficient for the cylinders, in order to take the forces occurring when polypropylene is the material used for the shells of the seat and back. In the dimensioning of the spring members 30 it was assumed that the spring members, loaded with a force of up to 15 kilograms at a point 30 cm above the seat, are rigid and that in the range between 20 and 25 kg they are resilient, and further that they have a strength under continuous load of 35 kilograms.

FIGS. 3 and 4 show two modifications of the type of fastening described above for securing the pegs 37, 38 in the cylinders 14, 15. In each case only the fastening on the seat 1 is shown, the fastening on the back 2 being identical, as is also clear from FIG. 2.

On the end surface of the peg 38 lies a disc 49 of resilient material, which has a central hole. The outside surface of this disc 49 is covered by a washer 48, and a screw 47 serves to compress the resilient disc 49, which thus serves the same function as the O-rings 40, 41. The head of this screw 47 is accessible through an opening 19 formed in the partition 17 and closed by a stopper 46.

The arrangement shown in FIG. 4 differs from that just described only in that the disc 49 is replaced by a ring 50 of rectangular cross-section, and also in that the peg 38 is provided, similarly to the arrangement shown in FIG. 3, with a cylindrical guide, which at the same time also limits the depth to which the screw 47 can be screwed in.

FIGS. 5 to 7 show a first application of the seat-back arrangement described to a chair and to an armchair provided with armrests. Here again the problem described above of the strength of polypropylene arises, and neither chair legs nor armrests can be screwed in the usual manner to the shells by screw connections. In FIG. 7 the channel 13 in the rib 11 of the shell 12 is shown clearly and to a larger scale, while FIG. 6 shows the rib 11 and the shell 12 in side view. As can be seen from these Figures, the two front chair legs 60, 61 have bent-over supporting parts 62 engaging in the channel 13. In this channel there are provided, for example, two eyes 63, 64, of which the rear eye 64 is clearly shown in FIG. 7. At the side of the eyes 63, 64 there is just sufficient room for the supporting part 62, so that the latter is pressed by means of a resilient disc 65 and a screw 66 against the outer wall of the channel 13, and is thus fastened. Here again one of the three arrangements shown in FIGS. 2 to 4 may be used.

The rear chair legs 67, 68 are joined together by means of a cross bearer 69. This cross bearer 69 is welded on the one hand to these rear chair legs 67, 68 and on the other hand to the supporting parts 62 of the front chair legs 60, 61.

The armrests 70 are pushed by means of an inserted part 71 into the rear chair legs 67, 18 and are fixed by means of a screw 72. Without these armrests, the opening in the rear chair legs can be blanked off by means of a plug of plastics material. As FIG. 5 shows, the rear chair legs 67, 68 are offset in the outward direction. This serves the purpose of enabling the chairs or armchairs to be stacked one on the other, as all specialists in the art will readily realise.

Another application, namely to an office chair, is illustrated in FIGS. 8 to 10. For the purpose of fastening the pillar 80 with the star-shaped arrangement of radiating arms and with the adjusting device 82, screws 84 are provided in the usual manner on a rigid underframe 83. As FIG. 10 shows, this underframe is in the form of a bearer construction suspended on both sides and comprising band-like bearers 85 fastened on retaining rails 86. The retaining rails engage in the side ribs 10, 11 of the shell 12 and are secured by clamp means, such as a washer, on an eye 88, the washer being compressed by a screw 89. The dimensions of the retaining rails 86 are so selected that between their outer face and the wall of the channel a space is left. A cover hood 90 can be inserted into this space of 3 to 4 mm, in order to protect the adjusting device 82 against dirt.

Armrests 91 may be constructed with a cantilever arm 92 and can be screwed from the outside to the retaining rails 86 by means of two screws 93, 94.

Through the abovedescribed construction of identically shaped shells for the seat and the back, it is possible to manufacture chairs, armchairs, and office chairs as mass produced articles, so that manufacture is substantially less expensive than was possible hitherto. The combination of seat and back can in addition be kept in stock as prefabricated products and the desired type of chair leg, with or without armrests, can then be screwed on by a simple operation in accordance with the purchaser's wishes.

I claim:

1. Chair comprising a seat and a back, together with spring members disposed between the seat and back for varying their mutual positions between two end positions by the application of a pressure counteracting the spring force, characterised in that the back (2) is fastened to the seat (1) by two connecting members (3, 4) which are rigidly fastened on the two adjoining side edge portions (10, 11) of the seat (1) and back (2) and which are composed of bent spring material in band form, and that chair-supporting means (5–8; 60, 61, 67, 68; 80) and optional armrests (70, 91) are fastened only to the seat (1);

in that the supporting ribs (10, 11) are in the form of channels (13) which are open at the bottom and which at the end intended for the fastening of the connecting members (3, 4) merge into a cylindrical tube (14, 15); and in that in the connecting members (3, 4) the spring material (30) in band form is rigidly connected, at both ends (33, 34) of the two arms (31, 32) enclosing an angle, to pegs (37, 38) fitting positively into the cylindrical tube (14, 15), and that, for the purpose of holding the peg (37, 38) in the tube (14, 15), a holding member (40, 41; 49; 50) deformable by pressure is provided.

2. Chair according to patent claim 1, characterised in that the seat (1) and the back (2) are in the form of identically shaped shells (12) provided with a concave curvature and lateral supporting ribs (10, 11).

3. Chair according to patent claim 1, characterised in that the holding member (40, 41) is an elastic member which is mounted on the peg (37, 38) and which is compressed between the peg and the partition (16, 17) by means of a screw (44, 45) screwed through the partition into the peg (37, 38), in order to exert a force against the wall of the tube.

4. Chair according to patent claim 3, characterised in that the elastic member is in the form of an O-ring (40, 41) and embraces a pin (42, 43) on the peg (37, 38), and that the thickness of the O-ring is greater than the height of the pin.

5. Chair according to patent claim 3, characterised in that the holding member (49, 50) rests on the plane end of the peg (37,38) and that for the purpose of producing the pressure on the holding member a screw (47) is screwed into the end face of the peg with the interposition of a washer (48) of rigid material.

6. Chair according to claim 3, 4, 5, or 1, characterised in that in each channel (13) there is provided at least one eye (64, 88) which is integrally joined to the wall of the supporting rib (10, 11) and reduces the width of the channel, and which has a threaded hole lying at right angles to the bottom of the channel, that the chair-supporting means is provided with a supporting member (62; 86) which at least approximately fills the space between the eye (64, 88) and the opposite wall of the supporting rib (10, 11), and that for the purpose of holding the supporting member (62,86) a resilient member (65, 87) and a screw, which applies pressure to the latter and is screwed into the screwthread of the eye (64, 88), are provided.

7. Chair according to claim 1 wherein both said seat and said back are made of polypropylene having a thickness such that it lacks the mechanical strength to withstand the clamping pressure between the head of an inserted screw and a cooperating clamping member.

8. Chair according to claim 1 wherein said chair-supporting means comprises legs (5–8; 60, 61, 67, 68).

9. Chair according to claim 1 wherein said chair-supporting means comprises a pillar (80).

* * * * *